US012529536B2

(12) United States Patent
Kim et al.

(10) Patent No.: US 12,529,536 B2
(45) **Date of Patent: *Jan. 20, 2026**

(54) UNIVERSAL MAGAZINE LOADING AND UNLOADING ACCESSORY

(71) Applicants: Kyung Young Kim, Portland, OR (US); Graham Karam Kim, Seattle, WA (US)

(72) Inventors: Kyung Young Kim, Portland, OR (US); Graham Karam Kim, Seattle, WA (US)

( * ) Notice: Subject to any disclaimer, the term of this patent is extended or adjusted under 35 U.S.C. 154(b) by 98 days.

This patent is subject to a terminal disclaimer.

(21) Appl. No.: 18/404,883

(22) Filed: Jan. 4, 2024

(65) Prior Publication Data

US 2024/0271895 A1 Aug. 15, 2024

Related U.S. Application Data

(63) Continuation-in-part of application No. 18/087,790, filed on Dec. 22, 2022, now Pat. No. 11,867,475.

(60) Provisional application No. 63/333,106, filed on Apr. 20, 2022.

(51) Int. Cl.
*F41A 9/83* (2006.01)

(52) U.S. Cl.
CPC ..... *F41A 9/83* (2013.01)

(58) Field of Classification Search
CPC ..... F41A 9/83
See application file for complete search history.

(56) References Cited

U.S. PATENT DOCUMENTS

| | | | |
|---|---|---|---|
| 3,939,590 | A | 2/1976 | Musgrave |
| 4,614,052 | A | 9/1986 | Brown et al. |
| 4,706,402 | A | 11/1987 | Csongor |
| 4,719,715 | A | 1/1988 | Howard |
| 4,827,651 | A | 5/1989 | Conkey |
| 4,993,180 | A | 2/1991 | Upchurch |
| 5,355,606 | A | 10/1994 | Origoni |
| 6,178,683 | B1 | 1/2001 | Williams |
| 6,189,254 | B1 | 2/2001 | Steitz |
| 6,219,953 | B1 | 4/2001 | Bentley |
| 6,810,616 | B2 | 11/2004 | Tal et al. |

(Continued)

OTHER PUBLICATIONS

International Search Report and Written Opinion for PCT/US2023/018746, mailed Sep. 18, 2023.

*Primary Examiner* — J. Woodrow Eldred
(74) *Attorney, Agent, or Firm* — Renaissance IP Law Group LLP

(57) ABSTRACT

An accessory facilitates loading and unloading of cartridges into a firearm magazine and includes a main body having a top end with a top opening, a bottom end with a bottom opening, a wall portions extending between the top and bottom ends and defining therebetween a body cavity in communication with the top and lower openings and also defining a front opening in communication with the body cavity. A first portion of the body cavity can receive a cartridge from the front opening and a second portion of the body cavity can receive an open end of a portion of a firearm magazine from the bottom opening. A thruster is movably coupled to the main body and mounted to the main body above the top end, and includes a plunger which is movable into and out of the first portion of the body cavity through the top opening.

19 Claims, 24 Drawing Sheets

(56) References Cited

U.S. PATENT DOCUMENTS

| | | | | |
|---|---|---|---|---|
| 7,805,874 | B2 | 10/2010 | Tal et al. | |
| 9,212,859 | B1 | 12/2015 | Tal et al. | |
| D829,295 | S | 9/2018 | Buckner | |
| 10,215,516 | B2 | 2/2019 | Hefer et al. | |
| 10,222,155 | B2 | 3/2019 | Hefer et al. | |
| 10,254,061 | B1 | 4/2019 | Loveday, IV et al. | |
| 11,029,108 | B1 | 6/2021 | Tal et al. | |
| 11,313,634 | B1 | 4/2022 | Newby et al. | |
| 11,867,475 | B2 * | 1/2024 | Kim | F41A 9/83 |
| 2018/0202735 | A1 | 7/2018 | Draper | |
| 2018/0321004 | A1 | 11/2018 | Fausti et al. | |
| 2022/0373280 | A1 | 11/2022 | Couie | |

* cited by examiner

UNIVERSAL MAGAZINE LOADING AND UNLOADING ACCESSORY

CROSS-REFERENCE TO RELATED APPLICATIONS

This application is a continuation-in-part of U.S. application Ser. No. 18/087,790, filed Dec. 22, 2022, which claims the benefit of U.S. Provisional Application Ser. No. 63/333,106, filed Apr. 20, 2022, each of which is incorporated herein by reference in its entirety.

TECHNICAL FIELD

Embodiments of the present inventive concept relate generally to firearms and, more particularly, to methods and accessories for facilitating loading and unloading of firearm cartridges into and out of a firearm magazine.

BACKGROUND

In order to achieve a higher capacity, many firearms utilize a "double stacked" magazine in which the cartridges are held in two adjacent columns where the cartridges are stacked in a staggered (zigzag) fashion. Such magazines achieve higher round capacity compared to single column magazines. The cartridges advance to the feed position, under spring pressure, as a group. Feeding takes place alternately from the left feed lip and the right feed lip of the magazine. The space between the feed lips is greater than the maximum diameter of a cartridge thus allowing convenient refilling of the magazine.

Magazines of handguns or pistols contain either a single column of cartridges, for smaller pistols or, for larger pistols, two staggered columns which converge to a single column at the open end of the magazine. Such magazines expose just a single, topmost cartridge, between both feed lips. These handgun magazines are not relevant to the embodiments of the present inventive concept.

Loading magazines with loose cartridges is a relatively time-consuming, tedious, and painful practice if done with bare fingers. Pain accumulates and intensifies as more rounds are loaded against the increasing spring pressure, thus slowing the loading process. In cases where the cartridges are short, it is particularly difficult to load a magazine by use of only human hands. Thus, it is useful to provide an apparatus for assisting in the magazine loading process.

A number of devices exist which are adapted to assist the user in loading firearm rounds into cartridges; however, such devices are dedicated to specific types of cartridges and magazines, and rely on custom features of the targeted magazine to securely attach thereto. These devices are not compatible not only between different size cartridges, but also different types of magazines. Therefore, users who own different types of magazines must purchase several different devices of the same function and feature.

SUMMARY

An accessory according to one embodiment of the present inventive concept facilitates loading and unloading of cartridges into a firearm magazine and includes a main body having a top end with a top opening, a bottom end with a bottom opening, a wall portions extending between the top and bottom ends and defining therebetween a body cavity in communication with the top and lower openings and also defining a front opening in communication with the body cavity. A first portion of the body cavity can receive a cartridge from the front opening and a second portion of the body cavity can receive an open end of a portion of a firearm magazine from the bottom opening. A thruster is movably coupled to the main body and mounted to the main body above the top end, and includes a plunger which is movable into and out of the first portion of the body cavity through the top opening.

BRIEF DESCRIPTION OF DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

DETAILED DESCRIPTION OF THE INVENTIVE CONCEPT

Terms such as front, rear, bottom, and bottom side view, are used herein as a convenient method for differentiating between the views or orientations shown in FIGS. 1 through 10. It will be appreciated that the elements shown in FIGS. may assume various orientations without deviating from the spirit and scope of this detailed description. Accordingly, the terms front, rear, bottom, front view, right side view, top view, rear view, left side view, bottom view, and the like should not be interpreted to limit the scope of the inventive concept recited in the attached claims.

Figure 1:
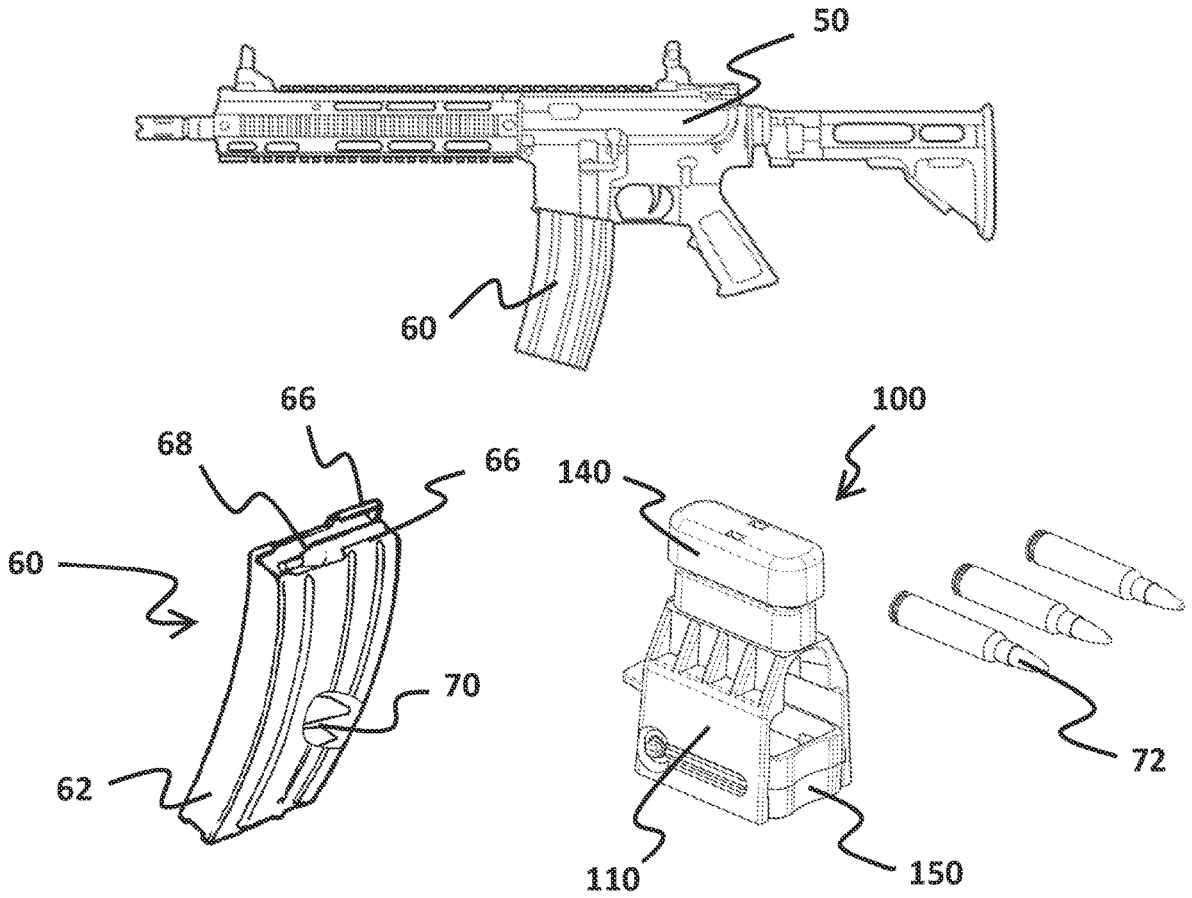
FIG. 1 is a perspective view showing a firearm, a plurality of cartridges, a magazine, and a magazine loader for loading cartridges into the magazine.

FIG. 1 is a perspective view showing a firearm 50, a plurality of cartridges 72, a magazine 60, and a magazine loader 100 for loading cartridges 72 into the magazine 60. The magazine loader 100 is comprised of a main body 110, a thruster 140, and a magazine clamp 150. The magazine 60 is comprised of a casing 62, a follower 68, and a spring 70. The open end of the magazine has cartridge-retaining lips 66 to contain loaded cartridges within the magazine 60.

Figure 2:
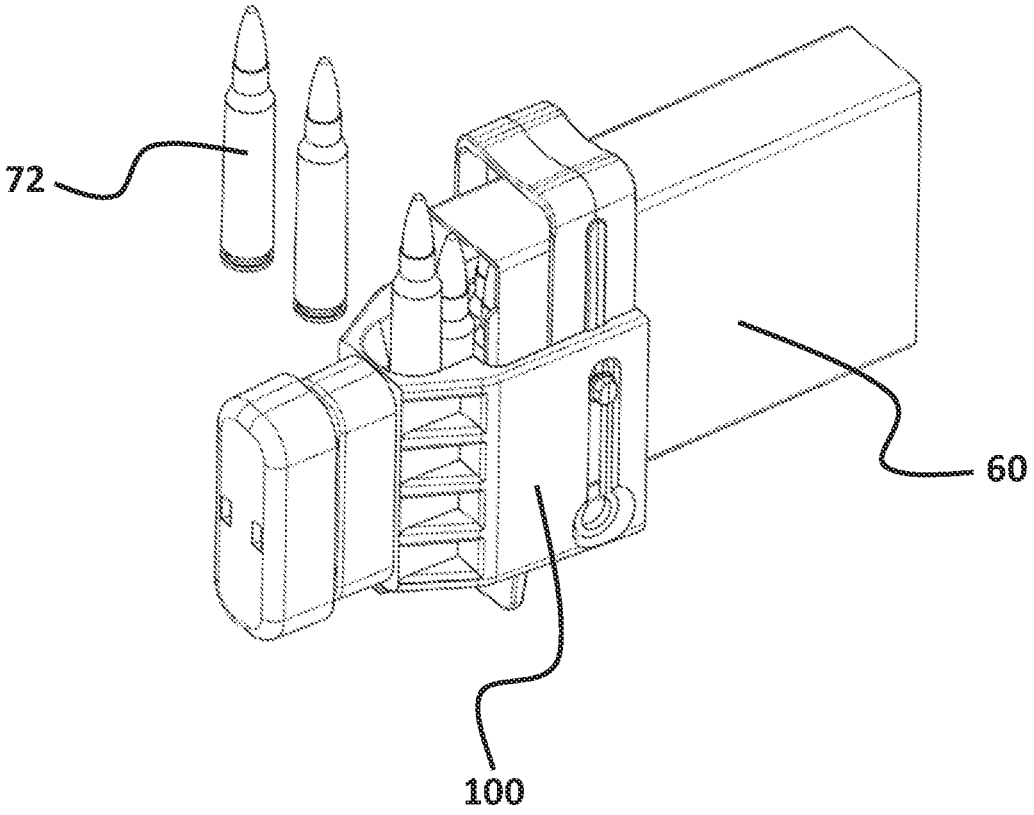
FIG. 2 is a perspective view showing a plurality of cartridges, a magazine, and a magazine loader. The magazine loader may be used to load a plurality of cartridges into the magazine.
Figure 3A:
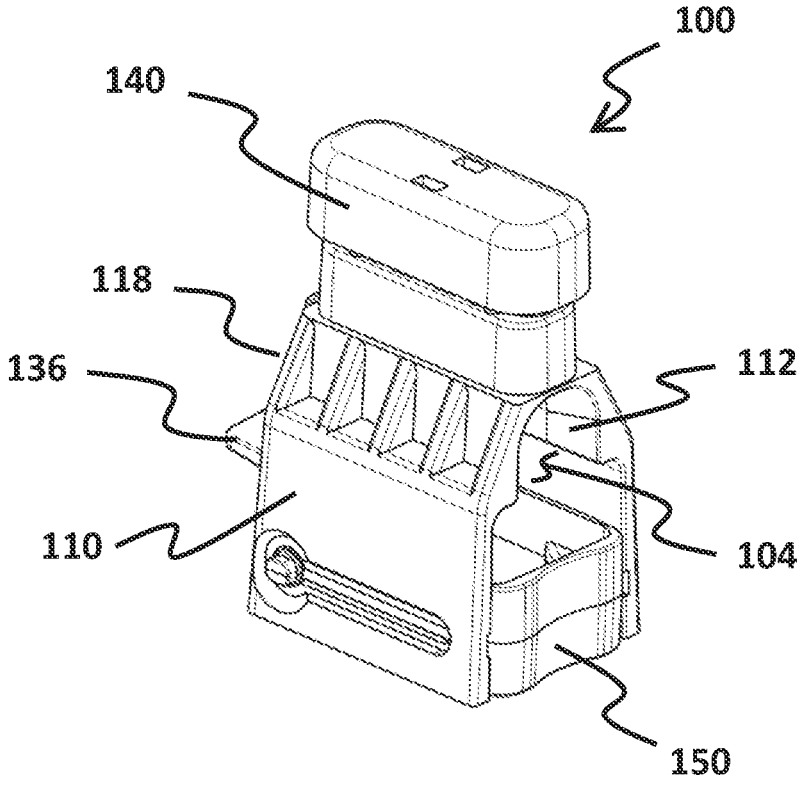
FIG. 3A is a perspective view of a magazine loader in accordance with the present inventive concept in storage or carry state.
Figure 3B:
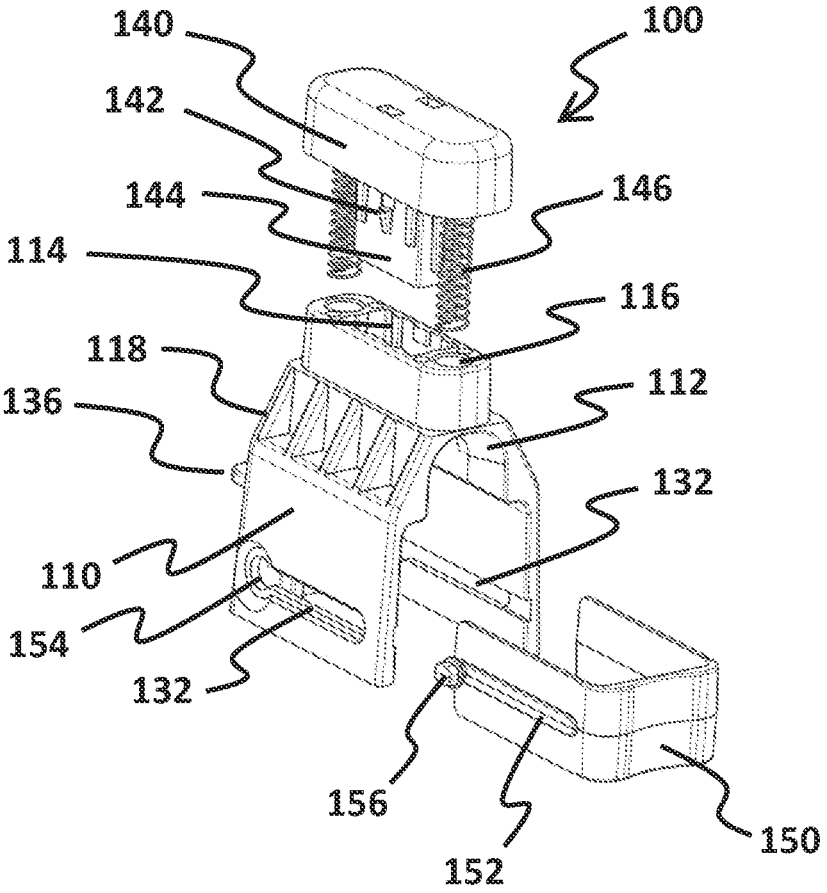
FIG. 3B is an exploded perspective view of a magazine loader in accordance with the present inventive concept.
Figure 3D:
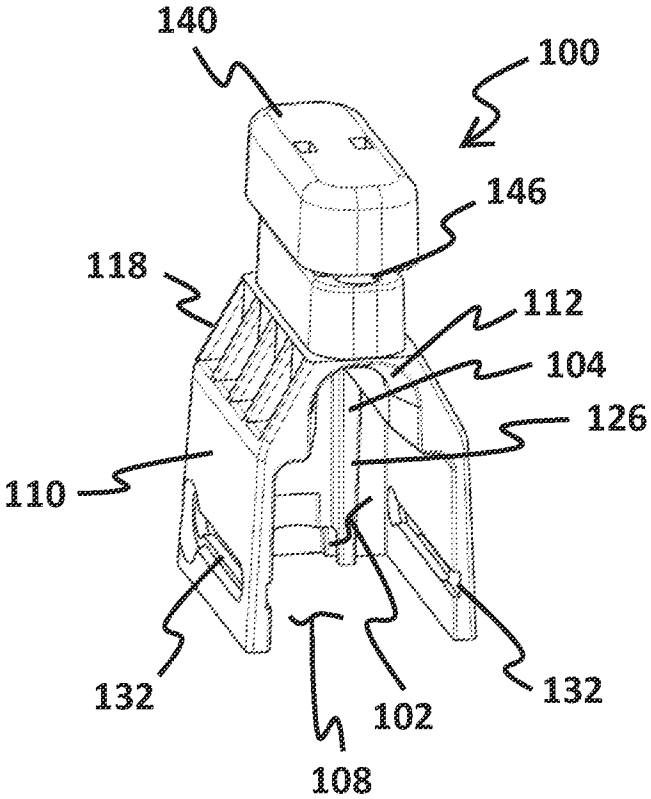
FIG. 3D is a front side perspective view without the magazine clamp in accordance with the present inventive concept.
Figure 3C:
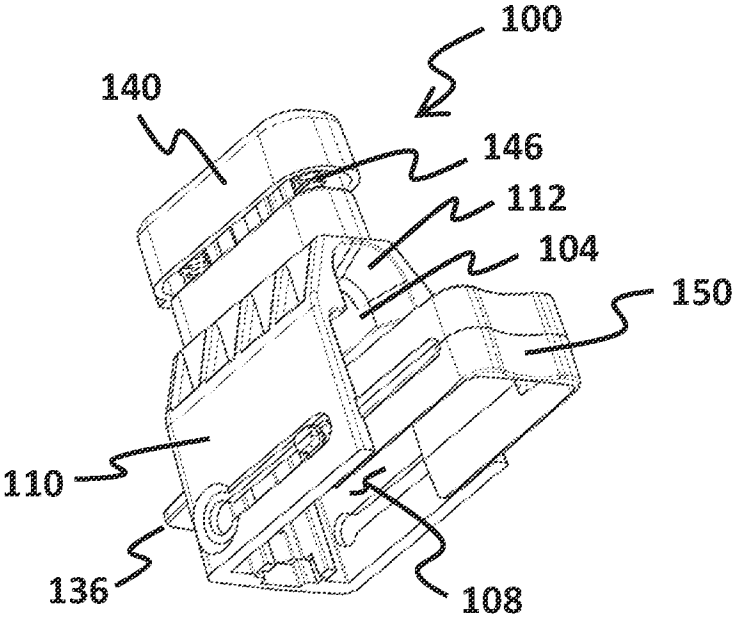
FIG. 3C is a bottom view of a magazine loader with the magazine clamp slid out in accordance with the present inventive concept.
Figure 4B:
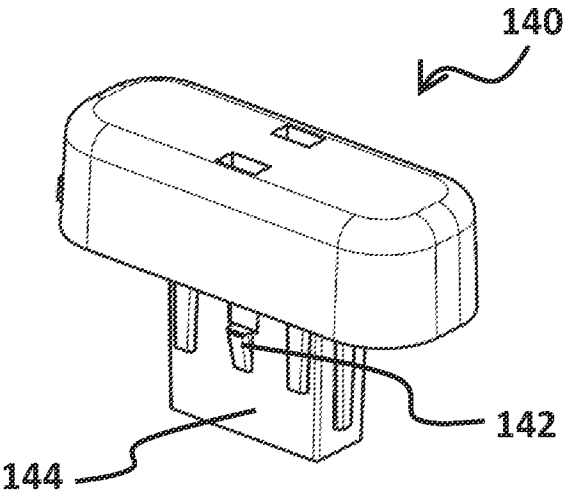
FIG. 4B is a top perspective view of the thruster of the magazine loader in accordance with the present inventive concept.
Figure 4A:
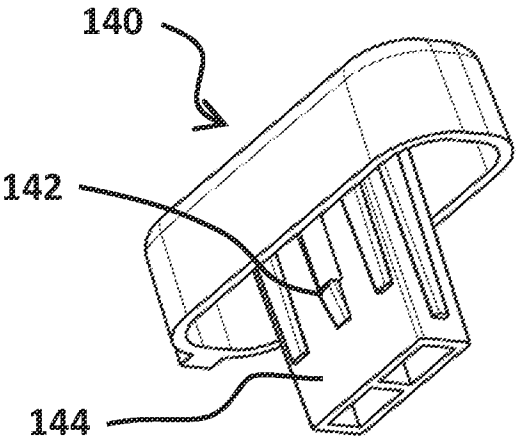
FIG. 4A is a bottom perspective view of the thruster of the magazine loader in accordance with the present inventive concept.
Figure 4D:
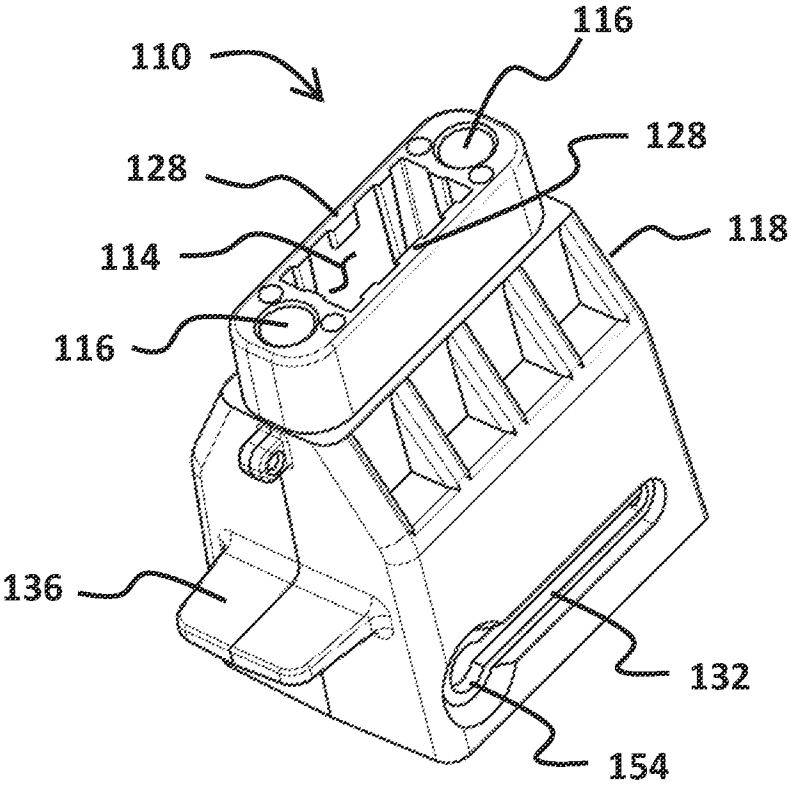
FIG. 4D is a rear perspective view of the main body of the magazine loader in accordance with the present inventive concept.
Figure 4C:
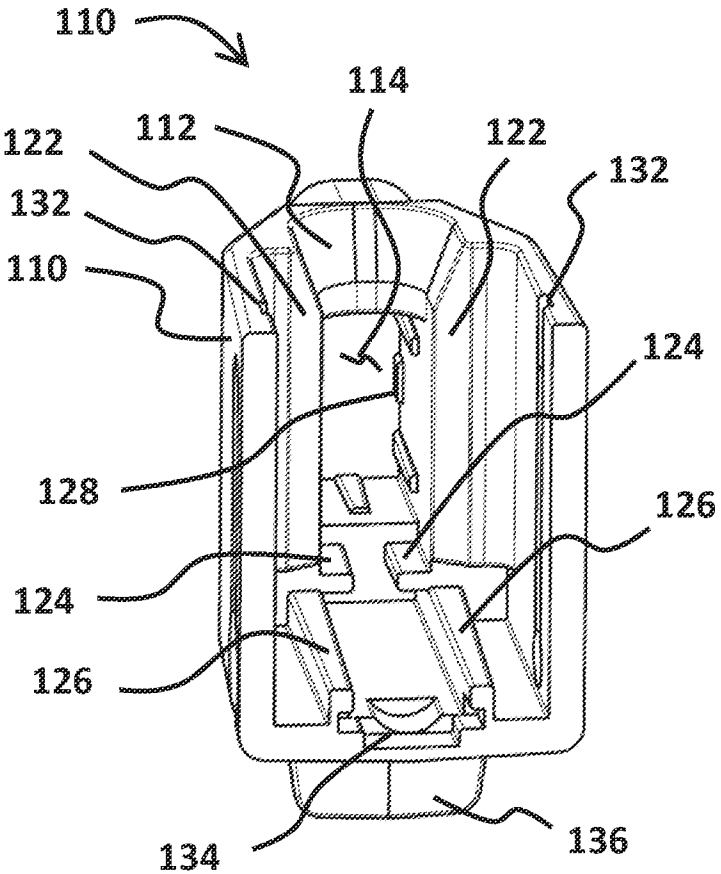
FIG. 4C is a bottom perspective view of the main body of the magazine loader in accordance with the present inventive concept.
Figure 4F:
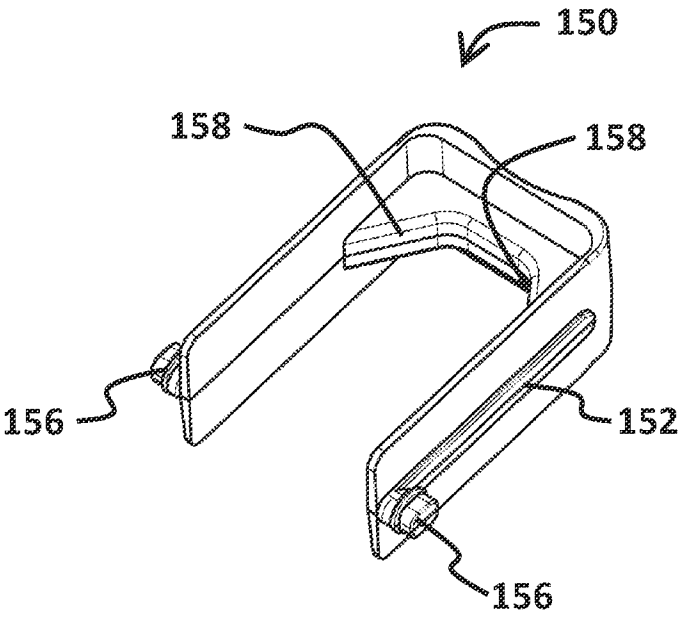
FIG. 4F is a rear perspective view of the magazine clamp of the magazine loader in accordance with the present inventive concept.
Figure 4E:
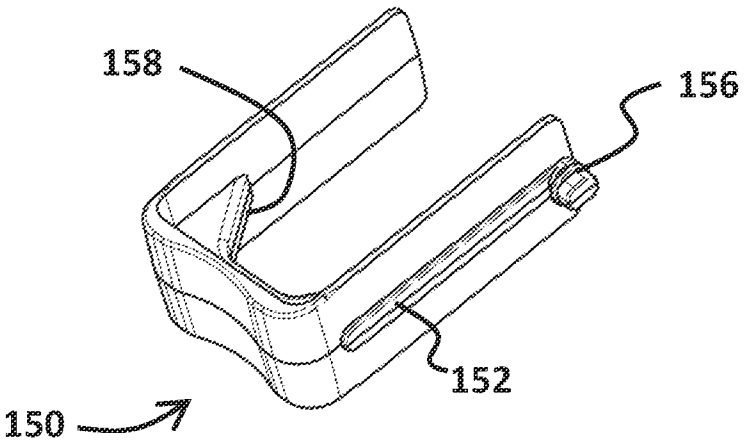
FIG. 4E is a front perspective view of the magazine clamp of the magazine loader in accordance with the present inventive concept.

FIG. 2 is a perspective view showing a plurality of cartridges 72, a magazine 60, and a magazine loader 100. The magazine loader 100 may be used to load a plurality of cartridges 72 into the magazine 60. The magazine loader 100 presented in this illustrated embodiment may also be used to unload a plurality of cartridges 72 in the magazine 60.

Referring, for example, to FIGS. 3A-4F, an example magazine loader 100 comprises a main body 110 for receiving an upper portion of the magazine 60 and a thruster 140 which moves up and down freely during loading action by operator through a thruster well 114 formed at the top of the main body 110 for loading cartridges 72 into the magazine 60 received by the main body 110.

An example of the magazine loader 100 is comprised of a main body 110, a thruster 140, and a magazine clamp 150. The main body 110 has a cartridge ramp 112 that guides the cartridge 72 into a cartridge cavity 104 when loading the cartridge 72. A plurality of stiffeners 118 are formed around the main body 110 to increase structural integrity of the main body 110. On the rear of the main body 110, an unloading flange 136 is formed. The unloading flange 136 may be used as a tool to unload cartridges 72 loaded in the magazine 60, and may also be used as a flange to grip the main body 110 with fingers during loading of the cartridges 72.

A plunger 144 is formed at the lower portion of the thruster 140 and moves up and down freely during loading action by operator through the thruster well 114 formed at the top of the main body 110. Two springs 146 residing in the spring pockets 116 formed at the top of the main body 110 support the thruster 140 and return the thruster 140 back to a "ready" position when a push-down force for loading a cartridge 72 is removed. Two thruster teeth 142 on opposite sides of the plunger 144 keep the thruster 140 inside the thruster well 114 by thruster stoppers 128 formed inside the thruster well 114. A magazine clamp 150 slides into and out of the main body 110 along guiding slots 132 formed in the main body 110. A pair of guide rails 152 formed along the sides of the magazine clamp 150 fit into the guiding slots 132 and move only along one axis that is parallel to the longitudinal axis of the guide rails 152. At the end of the guide rails 152, stoppers 156 are formed to prevent the magazine clamp 150 from being pulled out of the main body 110 totally. The magazine clamp 150 can be pulled out until the stoppers 156 hit the inside end of the guiding slot 132. A notch 154 is formed at the end of each guide slot 132. If the magazine clamp 150 should be removed totally from the main body 110, stop ends 156 and notches 154 should be aligned and both stop ends 156 of the magazine clamp 150 are pushed inwardly to disengage from the guiding slot 132 of the main body 110.

At the bottom of the main body 110, a bottom opening 108 through which the magazine 60 can pass is defined by three walls of the main body 110 and the magazine clamp 150. The bottom opening 108 is at a plane of a magazine cavity 102 (in which the magazine 60 can be accommodated)

formed by the main body 110 and the magazine clamp 150. By sliding the magazine clamp 150, the size of magazine cavity 102 and bottom opening 108 can be adjusted for the magazine 60 to be loaded with cartridges.

At a rear end of magazine cavity 102, on the inside rear wall of the main body 110, a pair of rear stops 126 are formed for a rear wall of the magazine 60 to contact and, thus, be benched when the magazine 60 is inserted into the magazine cavity 102 to load cartridges 72. At the top of magazine cavity 102 formed by the main body 110, top stops 122 (e.g., a pair of symmetrically-angled surfaces with round corners along the side walls of the main body 110) are formed to stop an open end 64 of a magazine 62 inserted into the magazine cavity 102 for loading.

At the rear end of the cartridge cavity 104, on the inside rear wall of the main body 110, cartridge stops 124 are formed to stop the rear end of a cartridge to be positioned inside or along the rear inside wall of the magazine 60. At the bottom of the inside rear wall of the main body 110, notches 134 may be formed to prevent locking features of certain types of magazines 60 from interfering with the rear inside wall of the main body 110.

On the rear outer wall of the main body 110, unloading flange 136 is formed not only to be used as an unloading tool but also used as a holding feature of the main body 110 by fingers when gripped for loading cartridges 72 into the magazine 60.

Inside of a magazine clamp 150, a pair of symmetrically-angled clamping surfaces 158 are formed to clamp the magazine 60 securely from the sides thereof to prevent side play and rotation when the magazine 60 is inserted into the magazine cavity 102. In some embodiments, clamping surfaces 158 may be made of compliant material firmly attached to the magazine clamp 150 to provide more friction and clamping force.

Referring, for example, to FIGS. 5A-6E, an example magazine loader 100 comprises a main body 110 and a magazine clamp 150 for receiving an upper portion of the magazine 60 and a thruster 140 moving into the main body 110 for loading cartridges 72 into the magazine 60 received by the main body 110. Here the magazine clamp 150 is shown to be pushed by a thumb 54, however it can be pushed in by any elastic means such as rubber band 56 shown in the drawing FIG. 5E to be wrapped around the main body 110 and the magazine clamp 150. Additionally or alternatively, the elastic means can be provided as a spring connected between the main body 110 and the magazine clamp 150, which biases the magazine clamp 150 into the main body 110. Thus, the elastic means is configured to resiliently retain the magazine clamp 150 inside the main body 110 by applying an elastic force on the magazine clamp 150 toward or against the inside rear wall of the main body 110; the elastic means thus facilitates clamping of magazine 60 the magazine 60 is inserted into the magazine cavity 102 of the main body 110 through the bottom opening 108.

Figure 5A:
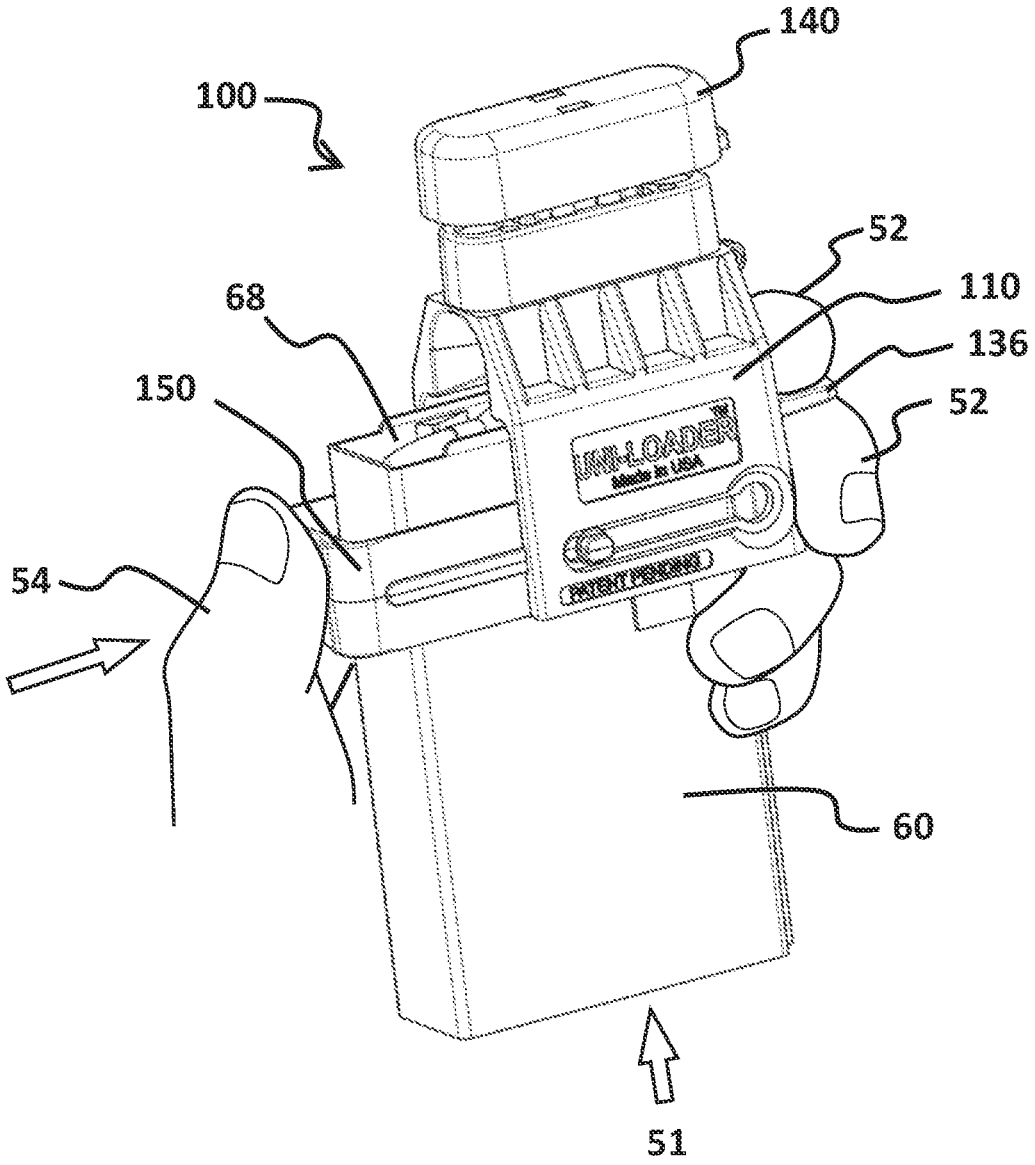
FIG. 5A is an illustration of an example of grip of the magazine loader with the insertion of a magazine in accordance with the present inventive concept.

To load cartridges 72 into a magazine 60, the magazine clamp 150 is moved outwardly to adjust the length of the bottom opening 108 so that the magazine 60 can be slid (open end 64 first) and upward into and through the bottom opening 108 (e.g., along an insertion axis extending along the direction of arrow 51 in FIG. 5A). Thereafter, the magazine 60 is arranged inside the magazine cavity 102 between the main body 110 and the magazine clamp 150 and is pushed upward (e.g., along the insertion axis) to make lips 66 of magazine 60 to be symmetrically and stably benched to top stops 122. Then the magazine clamp 150 is adjusted inwardly (e.g., by pushing with thumb 54) toward the main body 110 along the guiding slots 132 to securely clamp the magazine 60 between the clamping surfaces 158 and against rear stop 126 of the main body 110, which is held firmly by other fingers 52 to prevent any rocking while aligning the center of thruster well 114 and the center of the open end 64 of the magazine 60.

Once the magazine 60 is securely held in one hand, the cartridge cavity 104 of the magazine loader 100 can be oriented to face substantially upward for easy loading. A loose cartridge 72 is then rearwardly inserted into the cartridge cavity 104 (i.e., a space between the top of the open end 64 of inserted magazine 60 and the plunger 144 at the bottom of the thruster 140) along the cartridge ramp 112. Inserted cartridge 72 is stopped by cartridge stop 124 of the main body 110 and loosely positioned inside the cartridge cavity 104. Then the thruster 140 is pushed downward (e.g., as indicated by arrow 53 in FIG. 5D) for the plunger 144 to contact the cartridge 72 and further push the cartridge between the feed lips 66 of the magazine 60 and into the magazine 60. Once the cartridge 72 has fully passed the lips 66 and placed into the magazine 60, the thruster 140 can be released and returned to its original topmost position by spring 146 action, providing the cartridge cavity 104 between the open end 64 of the magazine and the plunger 144 of the thruster 140 for another cartridge 72 to be placed in the cartridge cavity 104. This process can be repeated until the desired number of cartridges 72 are loaded into the magazine 60, or until the magazine is full.

The thruster 140 can be pushed by the palm of the operator's non-gripping hand for easy loading. For an operator with strength, thruster 140 can be pushed by one or two fingers 52 of the gripping hand for speed loading (e.g., as shown in FIG. 5D).

FIGS. 7A-7D are partial cutaway views illustrating loading of different type cartridges (e.g., cartridges 72 and 92) into different magazines (i.e., magazine 60 in the case of cartridge 72, and magazines 90 and 98 in the case of cartridge 92).

Figure 6B:
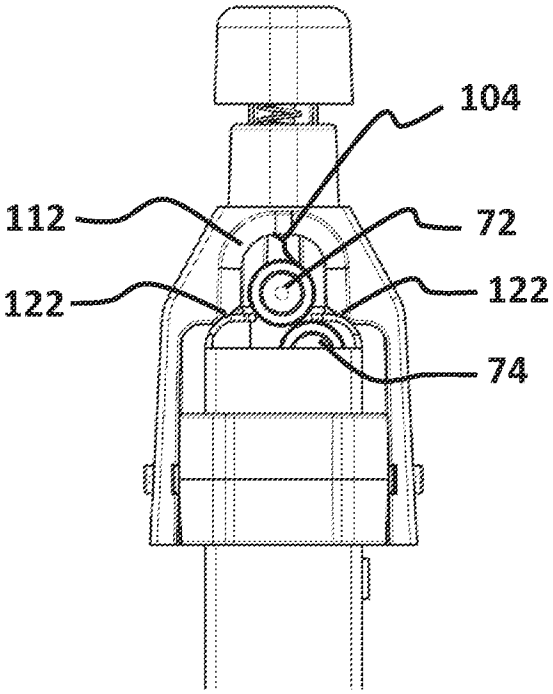
FIG. 6B is a front view of a new cartridge inserted in the cartridge cavity shown in FIG. 6A.
Figure 6A:
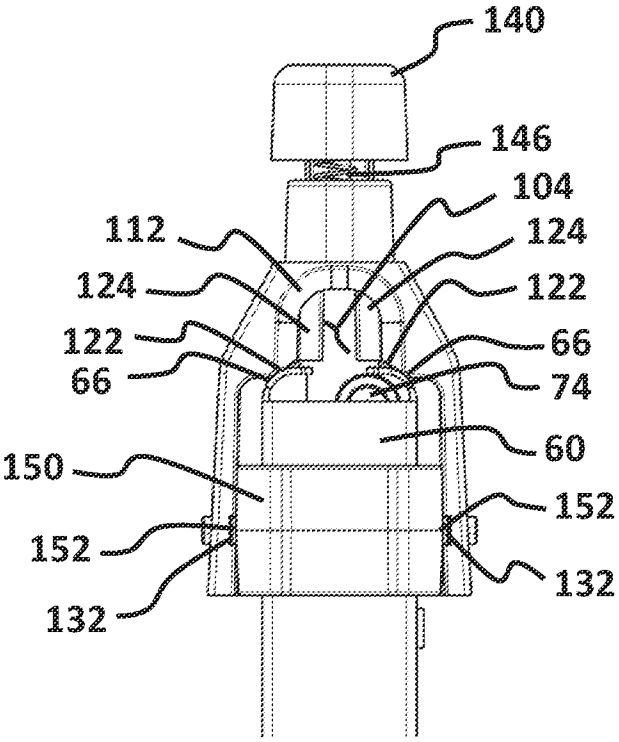
FIG. 6A is a front view of the magazine loader with a magazine ready for loading a cartridge in accordance with the present inventive concept.
Figure 6E:
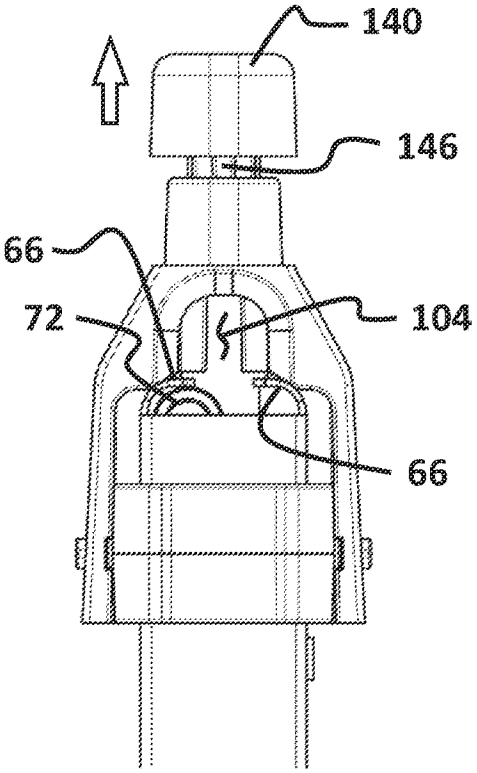
FIG. 6E is a front view of the thruster moving to top position by the springs and returning to ready position shown in FIG. 6A.
Figure 6D:
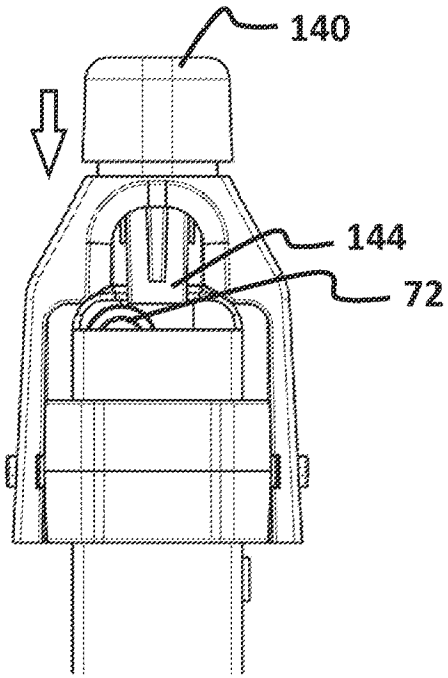
FIG. 6D is a front view of the plunger pushing down a cartridge fully into the magazine shown in FIG. 6B.
Figure 6C:
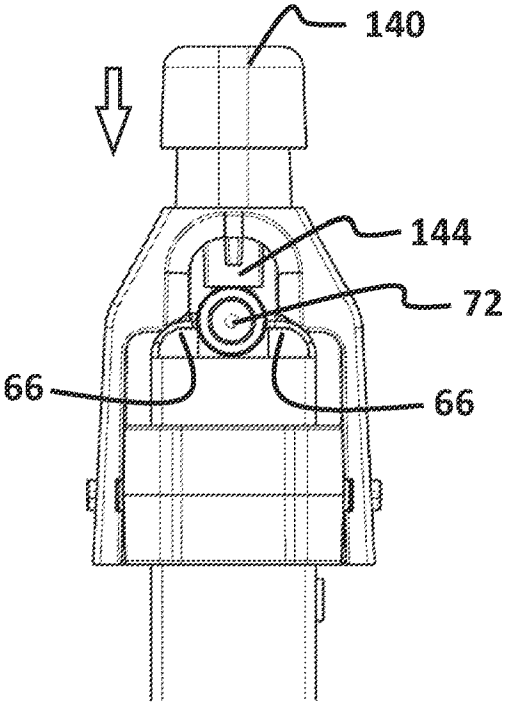
FIG. 6C is a front view of the plunger pushing down a cartridge shown in FIG. 6B.
Figure 7A:
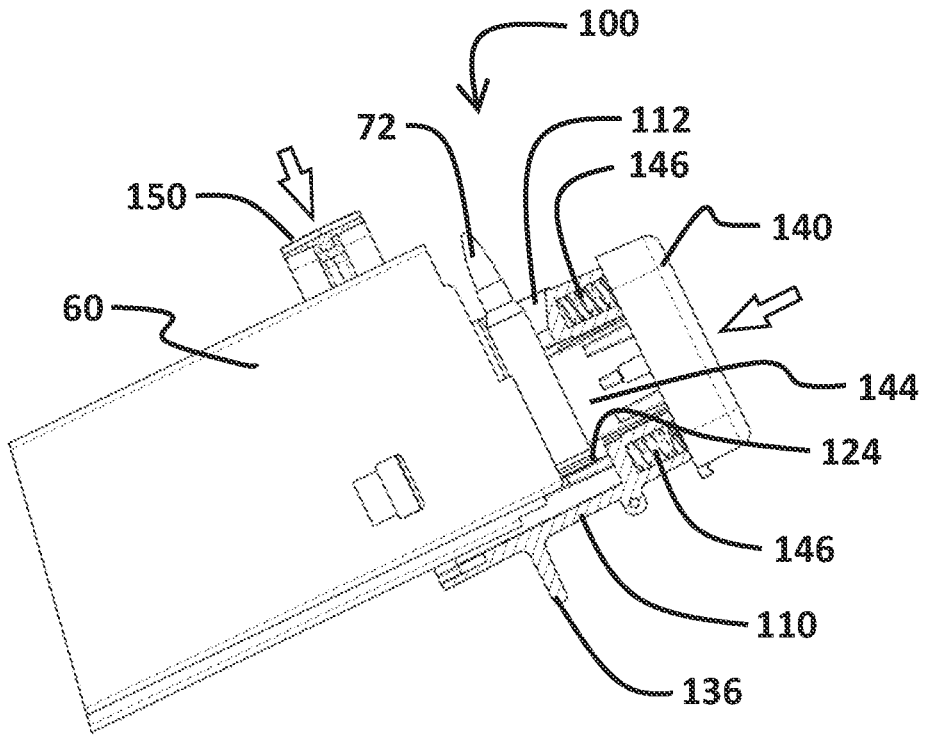
FIG. 7A is a partial cutaway side view illustrating the loading of a cartridge shown in FIG. 6C.

FIG. 7A is showing a cartridge 72 contacting cartridge stop 124 in the cartridge cavity 104 being pushed down by the thruster 140 as shown in FIG. 6C into a magazine 60 securely clamped by the magazine clamp 150.

Figure 7B:
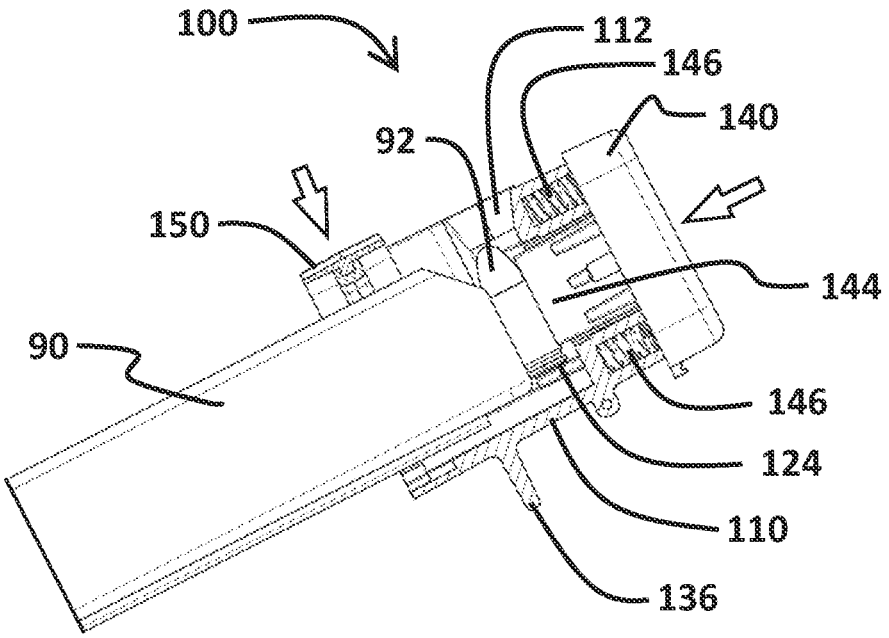
FIG. 7B is a partial cutaway side view illustrating the loading of another type cartridge to another magazine using an insert.

FIG. 7B is showing another type of cartridge 92 contacting cartridge stop 124 in the cartridge cavity 104 being pushed down by the thruster 140 into a magazine 90 securely clamped by the magazine clamp 150.

Figure 7C:
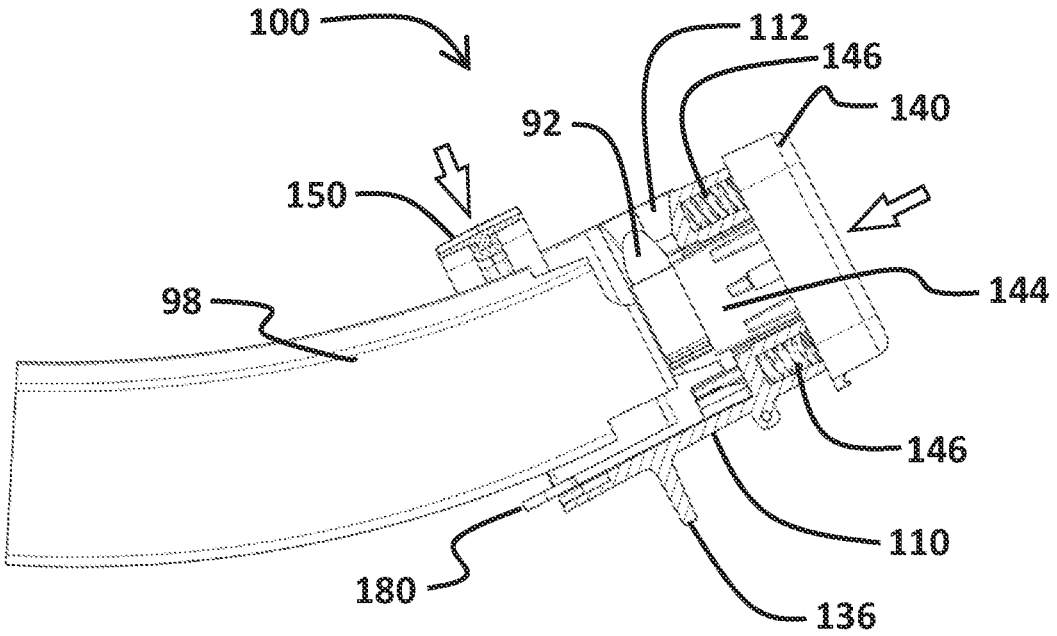
FIG. 7C is a partial cutaway side view illustrating the details of loading another type of cartridge to another magazine using an insert.
Figure 7D:
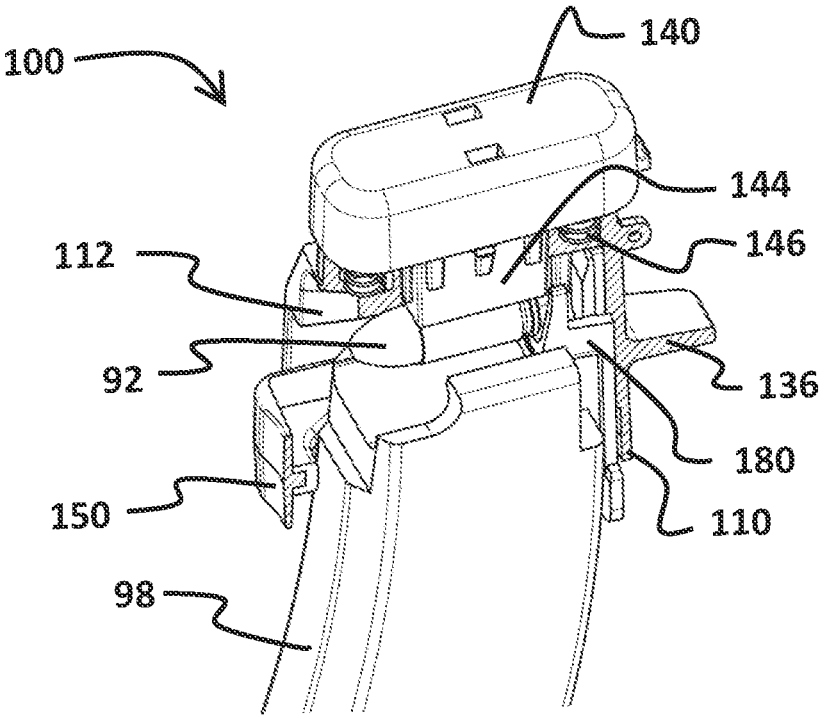
FIG. 7D is a partial cutaway perspective views illustrating the details of loading another type of cartridge to another magazine using an insert shown in FIG. 7C.

FIG. 7C-7D is showing the same type of cartridge 92 as shown in FIG. 7B being loaded in another type of magazine 98 whose inside rear wall is not aligned with cartridge stop 124. In this example, an insert 180 is used to align the end of the cartridge 92 to the rear inside wall of the magazine 98.

FIGS. 8A-8F are bottom side cutaway views illustrating an unloading sequence for an example magazine loader 100 with unloading flange 136 for a magazine 60 loaded with plurality of cartridges.

Figure 8B:
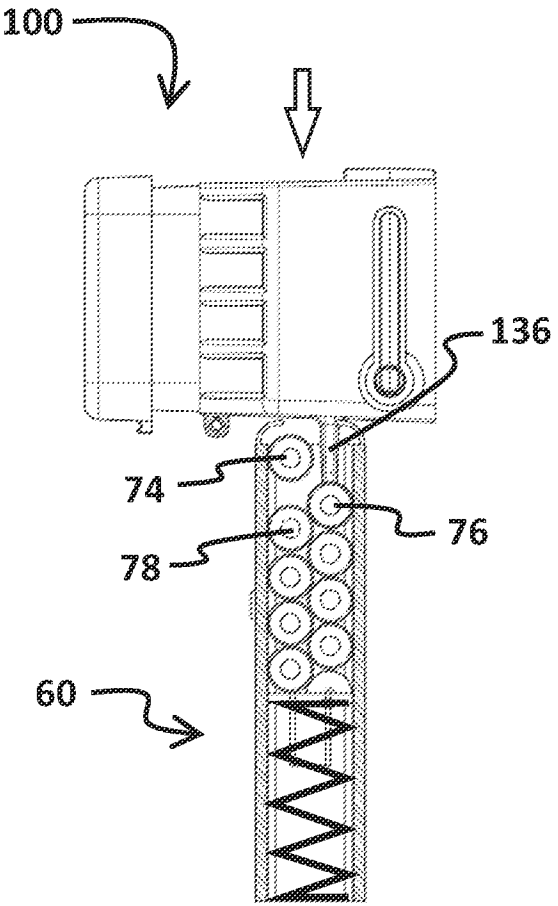
FIG. 8B is a bottom side cutaway view illustrating the topmost cartridge becoming loose in the magazine for unloading shown in FIG. 8A.
Figure 8A:
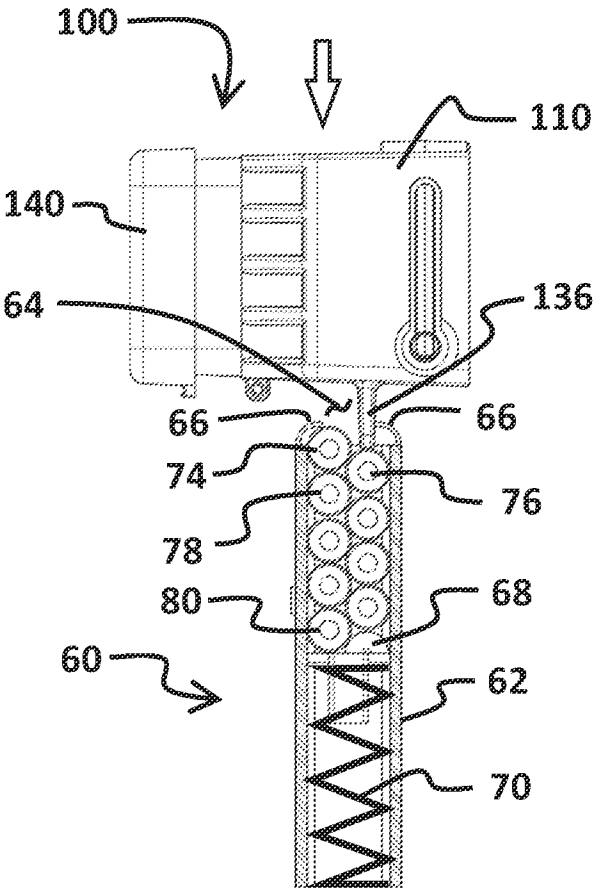
FIG. 8A is a bottom side cutaway view illustrating the unloading flange pushing the second-to-topmost cartridge in the magazine for unloading in accordance with the present inventive concept.

FIG. 8A is showing a loaded magazine 60 with topmost cartridge 74 and second-to-topmost cartridge 76 while the unloading flange 136 of a magazine loader 100 is about to touch second-to-topmost cartridge 76. Topmost cartridge 74 is shown also engaging a lip 66 of the magazine. All other cartridges 78 below second-to-topmost cartridge 76 and above the bottommost cartridge 80 above follower 68 are compressed by the spring 70. Such a position is at equilibrium since the lip 66 engages topmost cartridge 74 and the follower 68 engages the last cartridge 80 while casing 62 of magazine 60 constrains side motion from the upward force exerted by a spring 70 to form two columns of stacked cartridges inside of the magazine 60.

Figure 9A:
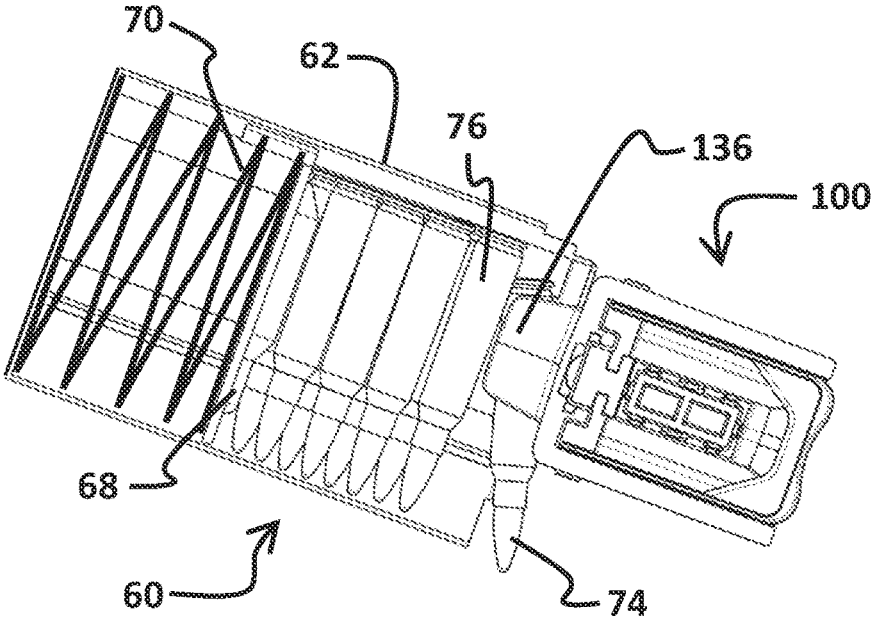
FIG. 9A is a side cutaway view illustrating the unloading flange pushing the second-to-topmost cartridge in the magazine for unloading shown in FIG. 8B.
Figure 9B:
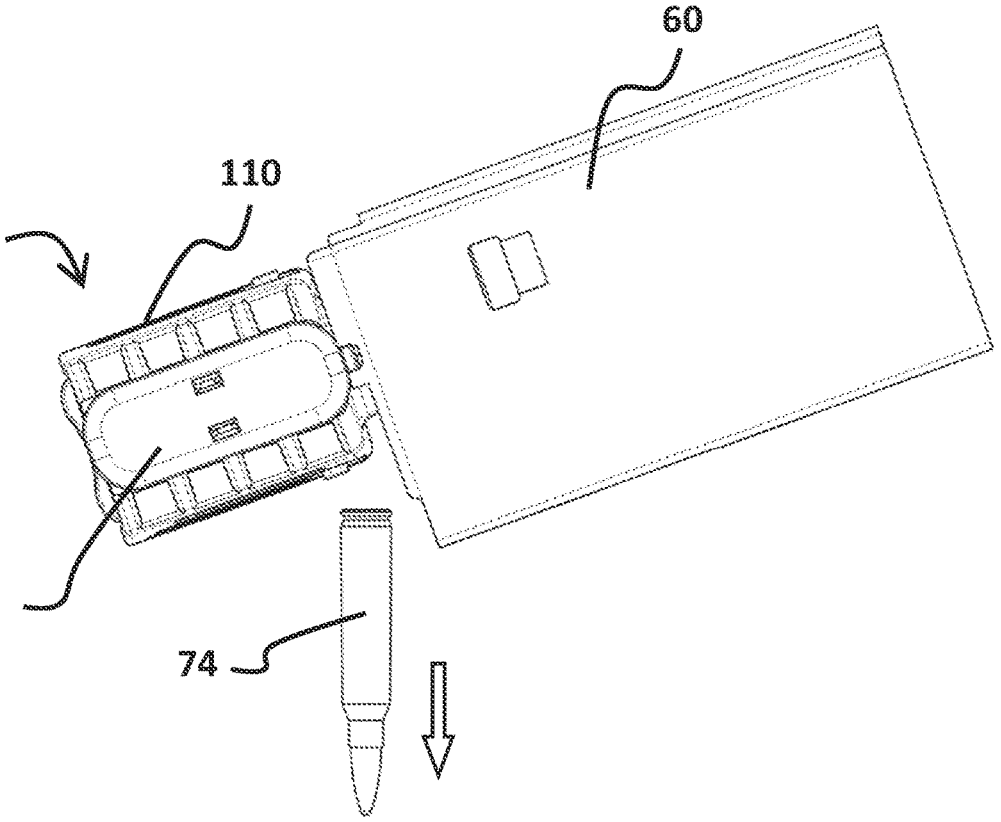
FIG. 9B is an opposite side view illustrating gravitational and forward unloading of a cartridge shown in FIG. 9A.
Figure 10B:
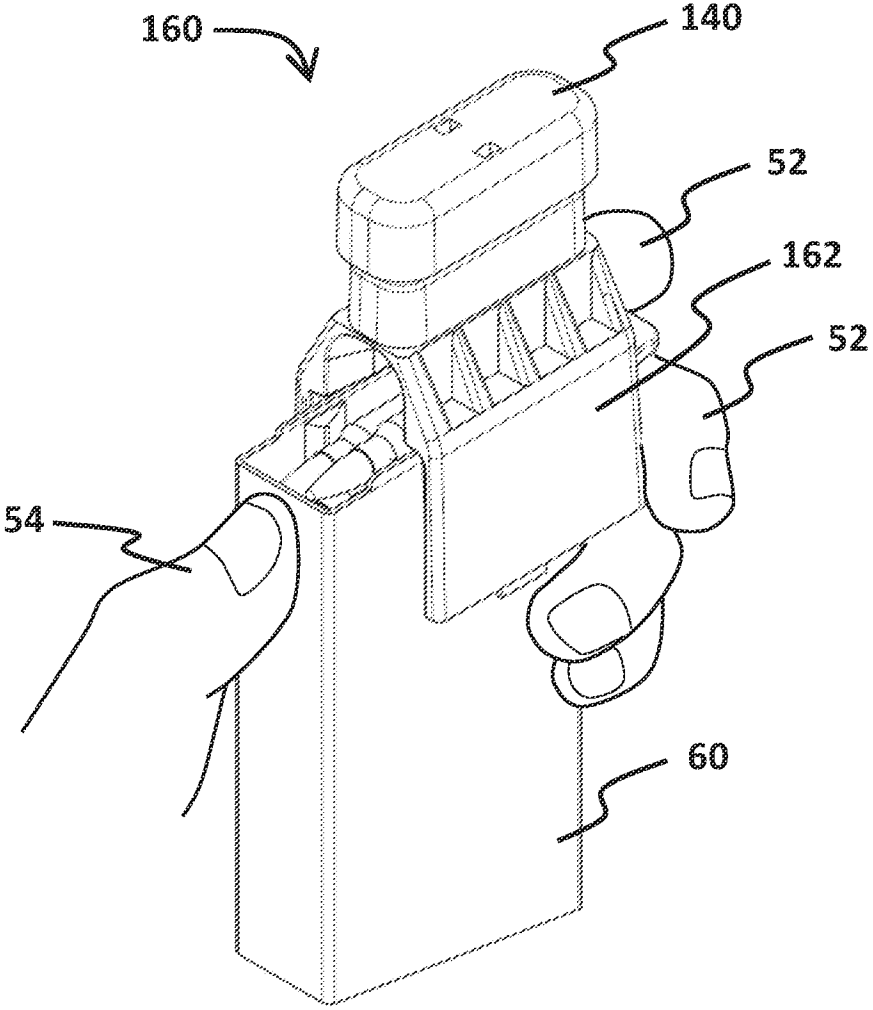
FIG. 10B is a perspective view with the magazine clamped by fingers for the embodiment shown in FIG. 10A.
Figure 10A:
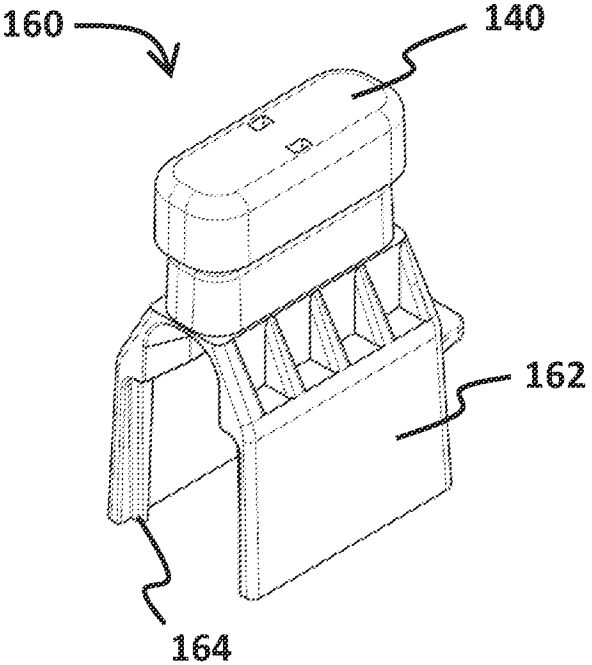
FIG. 10A is a perspective view of another embodiment in accordance with the present inventive concept.
Figure 10D:
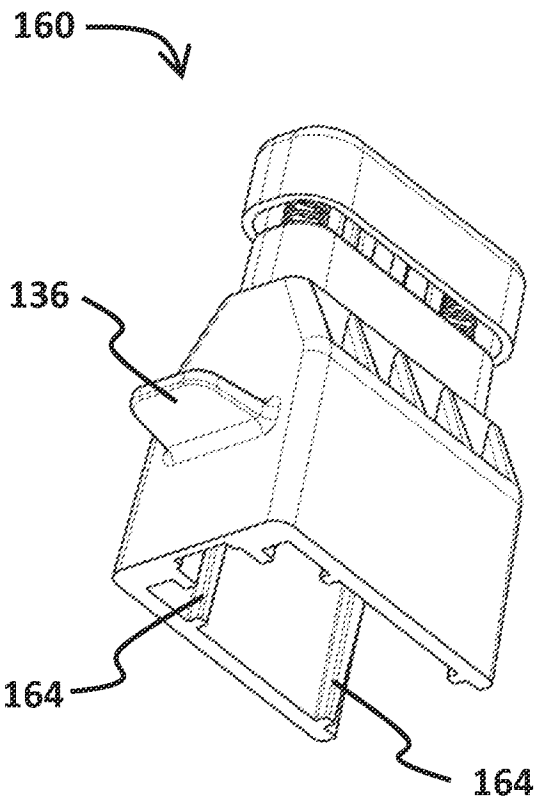
FIGS. 10C and 10D are detailed perspective views of another embodiment shown in FIG. 10A.
Figure 10C:
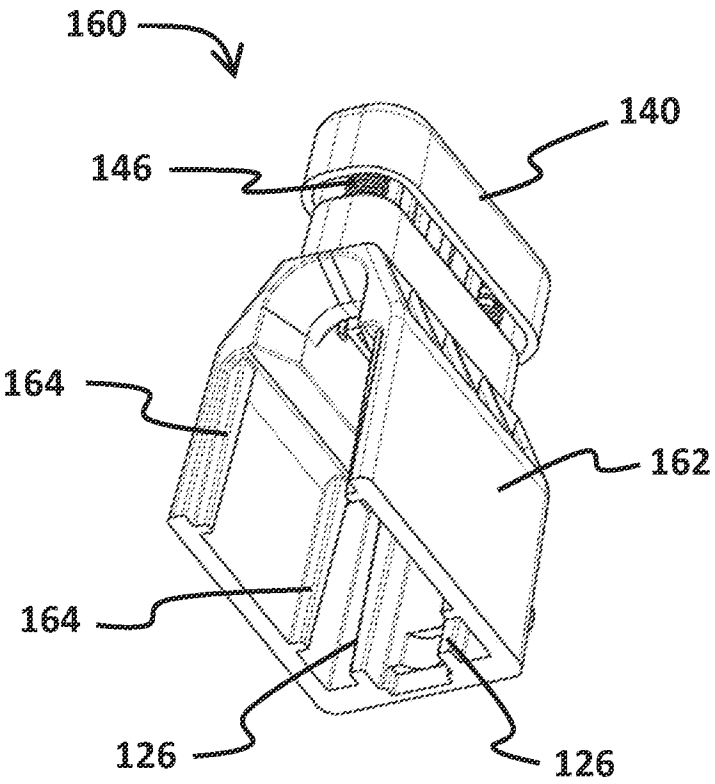

FIG. 8B is showing the unloading flange 136 of a magazine loader 100 pushed further down onto the second-to-topmost cartridge 76 through the open end 64 of a magazine until the rear wall of the main body 110 touches the lips 66 of the casing 62. Since the second-to-topmost cartridge 76 and all cartridges below it are pushed down, the topmost cartridge 74 disengages from the lip 66 and becomes loose, because upward spring force is eliminated. Then topmost cartridge 74 may fall out of the magazine 60 gravitationally and forwardly as shown in FIGS. 9A and 9B. After topmost cartridge 74 is unloaded from the magazine 60, the second-to-topmost cartridge 76 then becomes the topmost cartridge of the loaded magazine.

Figure 8D:
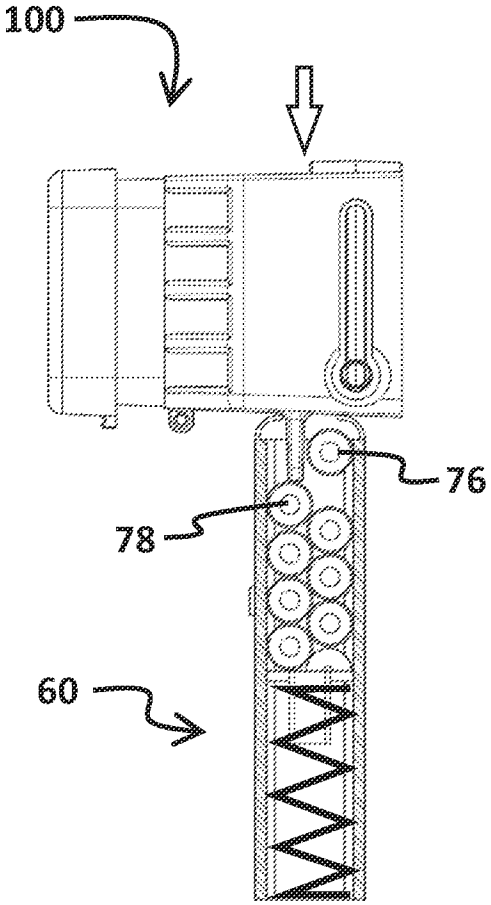
FIG. 8D is a bottom side cutaway view illustrating the new topmost cartridge becoming loose in the magazine for unloading shown in FIG. 8C.
Figure 8C:
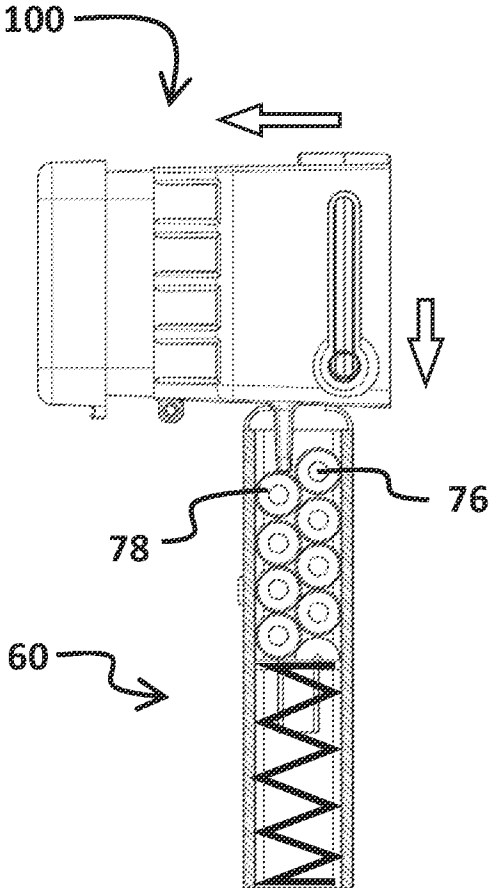
FIG. 8C is a bottom side cutaway view illustrating the unloading flange shift to the next second-to-topmost cartridge in the magazine for unloading shown in FIG. 8B.
Figure 8F:
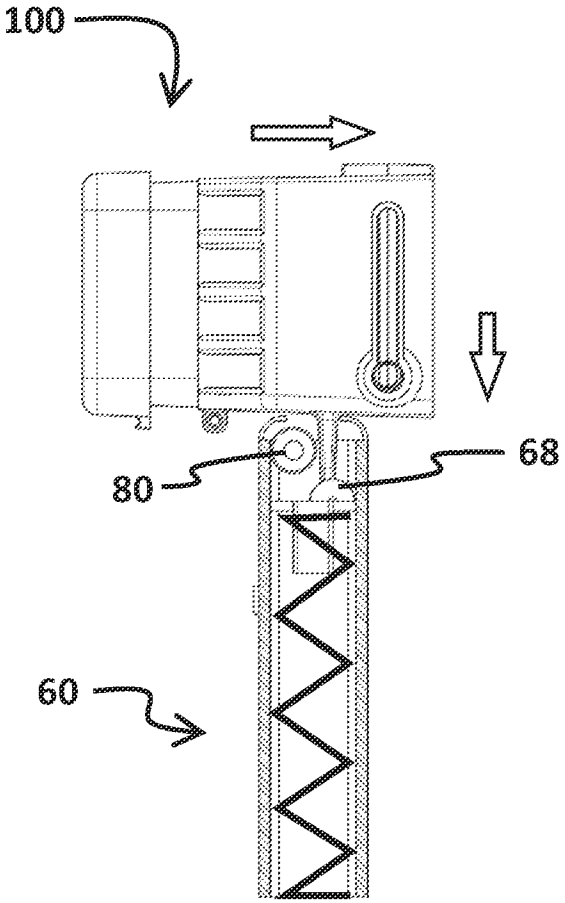
FIG. 8F is a bottom side cutaway view illustrating the unloading flange pushing the follower of the magazine down and the last cartridge becoming loose for unloading in accordance with the present inventive concept.
Figure 8E:
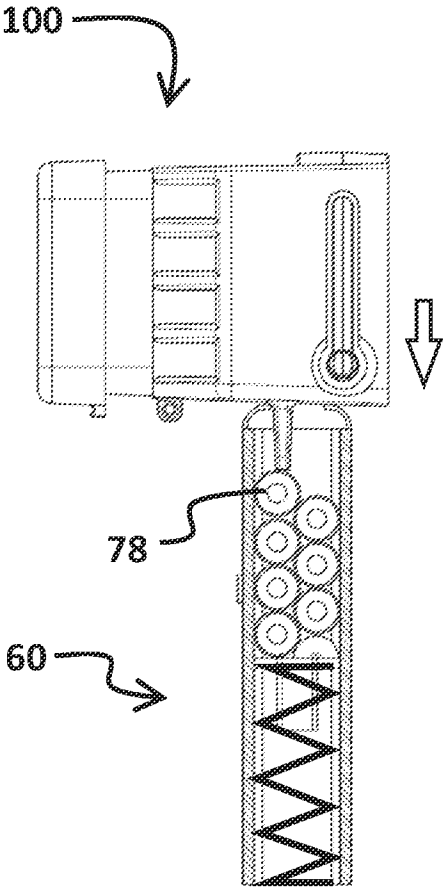
FIG. 8E is a bottom side cutaway view illustrating the magazine after unloading of the loose cartridge shown in FIG. 8D.

FIGS. 8C-8E are showing the unloading flange 136 of the magazine loader 100, while rear wall of the main body 110 is maintaining contact with the lips 66 of the casing 62, slide from (newly topmost) cartridge 76 over to next column of stacked cartridges and pushing down onto the (newly second-to-topmost) cartridge 78. Now the cartridge 76 becomes loose because it is disengaged from the unloading flange 136 and the upward spring force is eliminated. The cartridge 76 may then fall out of the magazine gravitationally and forwardly in the same manner as shown in FIGS. 9A and 9B for previously-unloaded cartridge 74.

Referring, for example, to FIGS. 8B-8E, the same unloading sequence discussed above with respect to FIGS. 8A and 8B may be repeated until the last cartridge 80 becomes the topmost cartridge. FIG. 8F shows the unloading flange 136 moving from the topmost cartridge 80 to the follower 68 of the magazine 60. Now the topmost cartridge 80 becomes loose and falls out of the magazine gravitationally and forwardly.

FIGS. 9A and 9B are side views of a magazine loader 100 and coupled magazine 60 positioned for unloading rounds from the magazine 60. Here the front opening of the magazine loader 100 faces substantially downward. A single loose cartridge 74 is shown being forwardly unloaded and free-falling from the magazine 60 gravitationally.

FIGS. 10A-10D are perspective views showing another embodiment in accordance with the present inventive concept. In this example of embodiment, a magazine loader 160 is composed of a thruster 140 and a main body 162 without a magazine clamp. This type of magazine loader can be a single purpose loader made for certain size magazines instead of universal loader. Plural side guides 164 are formed along the inside walls of the main body 162 which gives proper gap for an intended type of magazine to be inserted easily while preventing too much side rocking during loading. The magazine 60 can be clamped by a user's thumb 54 and other fingers 52 against rear stop 126 so that the magazine 60 can be securely held inside the loader 160 at a proper position so cartridge can be loaded.

The magazine loaders according to the various embodiments of the present inventive concept as described above provide substantial assistance to a firearm user in safely and rapidly loading and unloading a magazine. The magazine loaders may be adapted to operate with any type of double-stacked magazine and with any common cartridges.

Loading cartridges into the magazine is based on the method of pushing cartridges between a magazine's lips along the side walls of cartridge cavity where a cartridge is inserted rearwardly (rim/flange first). This is accomplished by providing a downward thrust on the cartridge to be loaded into the magazine, and thus on all previously-loaded cartridges within the magazine, to lower the cartridge to be loaded against the spring force of the follower in the magazine by a plunger formed in the thruster. The thruster will return to its top position by the return springs for next cartridge loading.

Figure 5B:
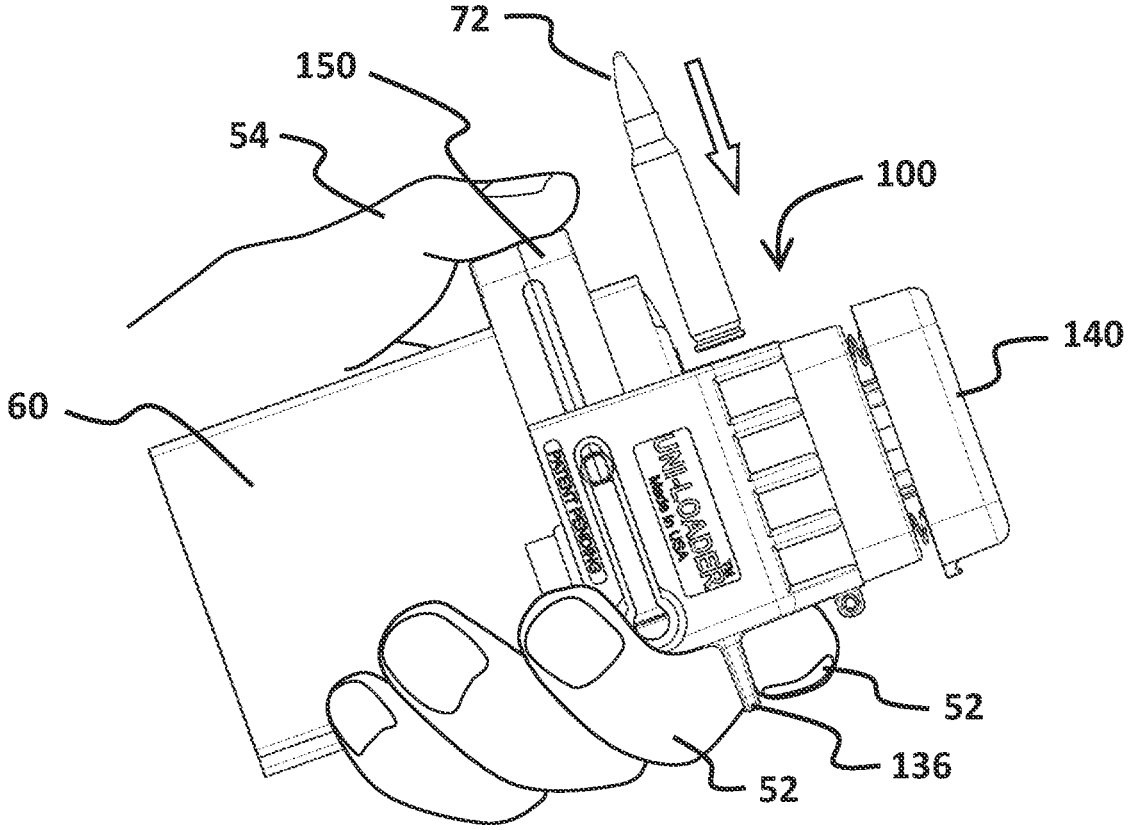
FIG. 5B is an illustration of a cartridge insertion with the grip of the magazine loader shown in FIG. 5A.
Figure 5D:
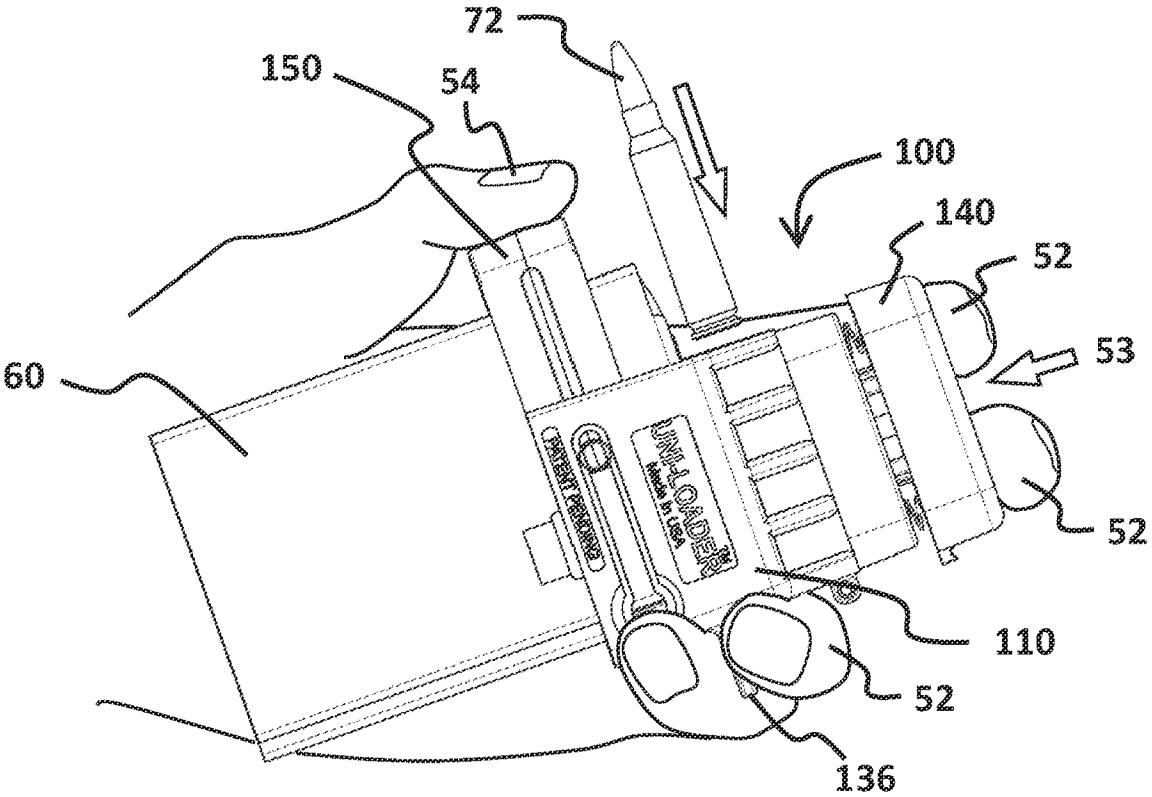
FIG. 5D is an illustration of another example of grip of the magazine loader in accordance with the present inventive concept. In this example, two fingers of the same gripping hand may be used to thrust a cartridge into the magazine.
Figure 5C:
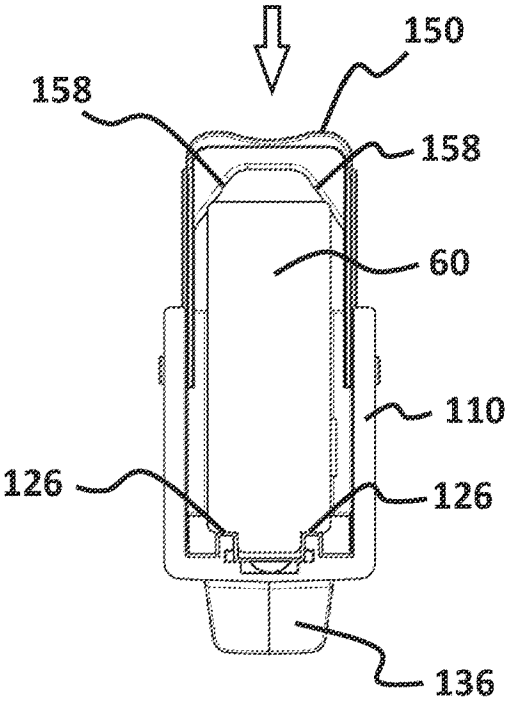
FIG. 5C is a bottom view of a cartridge insertion showing clamping of a magazine of the magazine loader shown in FIG. 5A.
Figure 5E:
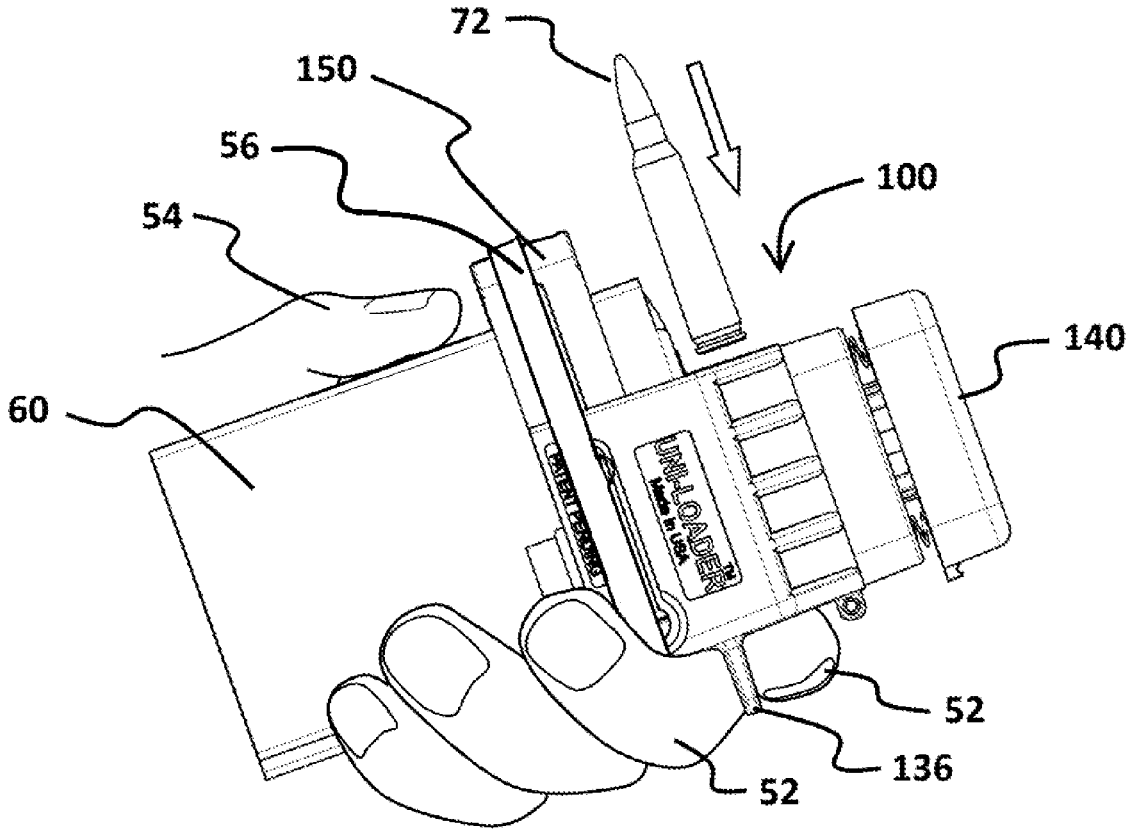
FIG. 5E is an illustration of an elastic means provided with the magazine loader in accordance with an embodiment of the present inventive concept.

In practice, the user holds the magazine loader and coupled magazine in one hand (e.g., the left hand), where the magazine loader's front is directed substantially upward (e.g., as shown in FIG. 5B). At the same time, the user may push the magazine's opposite closed end against the user's abdomen (not shown). The user may employ the palm of the right hand, or one or more of the free fingers of the left hand to push the thruster down and then let go as the right hand rearwardly feeds each loose cartridge into the cartridge cavity formed in the main body. Hence, every time the thruster is returned to the "ready" position, a single cartridge can be loaded into the cartridge cavity.

Unloading a cartridge from the magazine is based on the method of releasing spring pressure from the topmost cartridge of the magazine so that it may fall gravitationally and forwardly (bullet first) from the magazine, i.e., free-fall. This is accomplished by providing sufficient thrust into the magazine on the second-to-topmost cartridge, and thus on all previously loaded cartridges, for releasing the spring pressure from the topmost cartridge, allowing it to unload.

In practice, the user holds the magazine in, say, a left hand, where the cartridges are directed substantially downwards to earth as in FIG. 9B. The right hand is used to hold the magazine loader to push the second-to-topmost cartridge in the magazine with the unloading flange until the rear wall of the magazine loader is stopped by the lips of the magazine. This will allow the topmost cartridge to free-fall out of the magazine as in FIG. 9B. Then quickly reciprocating the unloading flange left-and-right between the two lips of the magazine allows the cartridges to free-fall out of the magazine in quick succession. Hence, every time the unloading flange is moved to the other lip, a single cartridge is unloaded.

Constructed as exemplarily described above, the magazine loaders according to any of the aforementioned embodiments provide several advantages over conventional magazine loaders: a single device can be used with a plurality of magazine shapes and calibers, eliminating the need for multiple devices of each magazine shape; a single device can both load and unload magazines; the device can be operated at high speed with minimal fatigue to the user; the thruster can be pushed by palm or any flat surface for weak or injured user; the thruster can be pushed using one or two fingers of the same hand holding magazine for faster loading; the device is small, lightweight and inexpensive.

These and other advantages will become further apparently from the following detailed description, accompanying drawings, and appended claims.

The invention claimed is:

1. An accessory for facilitating the loading and unloading of cartridges into a firearm magazine configured to accommodate a plurality of cartridges arranged in first and second columns of cartridges, the magazine including an open end through which the plurality of cartridges can be loaded into one of the first and second columns, wherein a width of the open end is wider than a diameter of the plurality of cartridges, the accessory comprising:

a main body including:

a top end having a top opening formed therein;

a bottom end having a bottom opening formed therein; and a plurality of wall portions extending between the top end and the bottom end, defining therebetween a body cavity in communication with the top opening and the lower opening, and also defining a front opening in communication with the body cavity, wherein a first portion of the body cavity is sized and configured to receive a cartridge from the front opening, and wherein a second portion of the body cavity is sized and configured to receive a portion of the magazine having the open end from the bottom opening;

a thruster movably coupled to the main body and mounted to the main body above the top end, wherein the thruster includes a plunger which is movable into and out of the first portion of the body cavity through the top opening.

2. The accessory of claim 1, wherein the thruster is movably coupled to the main body such that the plunger is movable into and out of the second portion of the body cavity through the top opening.

3. The accessory of claim 1, wherein the main body comprises a stopper arranged within the top opening, and the thruster has a tooth configured to engage with the stopper to limit upward motion of the thruster relative to the main body.

4. The accessory of claim 3, further comprising a spring installed between the main body and the thruster, wherein the spring is configured to bias the thruster in the upward motion relative to the main body.

5. The accessory of claim 1, further comprising a magazine clamp movably coupled to the main body, wherein the magazine clamp is movable into and out of the second portion of the body cavity through the front opening such that the magazine can be selectively captured between the magazine clamp and a rear wall portion of the plurality of wall portions.

6. The accessory of claim 5, further including a pair of guiding slots formed opposing side wall portions of the plurality of wall portions, wherein the magazine clamp is configured to slide within pair of guiding slots.

7. The accessory of claim 6, further including a pair of symmetrically-angled clamping surfaces configured to contact adjacent edges of the magazine.

8. The accessory of claim 1, wherein the plurality of wall portions of the main body include two opposing side wall portions and a rear wall portion connected between the side wall portions, and at the second portion of the body cavity, the side wall portions are spaced apart from each other by a distance that is wider than a maximum width of the magazine.

9. The accessory of claim 1, wherein the plurality of wall portions of the main body include two opposing side wall portions and a rear wall portion connected between the side wall portions, and at the first portion of the body cavity, the side wall portions are spaced apart from each other by a distance that is wider than a maximum diameter of a cartridge to be loaded into the magazine and narrower than a width of cartridge-retaining lips of the magazine.

10. The accessory of claim 1, wherein the main body has a pair of downward and symmetrically-chamfered surfaces proximate the top end of the second portion of the body cavity.

11. The accessory of claim 1, further comprising a horizontal flange positioned at the outside of main body on a wall portion the opposite the front opening, wherein the horizontal flange is insertable into the magazine when the magazine is not inserted into the second portion of the body cavity.

12. The accessory of claim 9, wherein the main body has a guiding ramp extending from the front opening at the first portion of the body cavity.

13. The accessory of claim 9, wherein a portion of the main body at a rear end of the second portion of the body cavity has defines a hollow space.

14. The accessory of claim 13, wherein the hollow space is aligned with a center of the second portion of the body cavity.

15. The accessory of claim 14, further comprising an insert, wherein the insert is insertable into the body cavity through the bottom opening and is configured to adjust a size of the first portion of the body cavity.

16. The accessory of claim 14, further comprising an insert, wherein the insert is insertable into the body cavity through the bottom opening and is configured to adjust a size of the hollow space of the body cavity.

17. The accessory of claim 8, further comprising a plurality of protruding side guides on each of the two opposing side wall portions of the second portion of the body cavity, wherein, on each of the two opposing side wall portions of the second portion of the body cavity, two of the plurality of protruding side guides are spaced apart from each other by a distance approximately equal to a width of the magazine.

18. The accessory of claim 8, wherein the two opposing side wall portions of the second portion of the body cavity are spaced to approximate the width of the magazine.

19. The accessory of claim 5, wherein the magazine clamp has an elastic means for retaining the magazine clamp inside the second portion of the main body by applying a force on the magazine clamp toward the rear wall portion of the plurality of wall portions.

* * * * *